United States Patent [19]

Melton et al.

[11] 4,144,057

[45] Mar. 13, 1979

[54] SHAPE MEMORY ALLOYS

[75] Inventors: Keith Melton, Busslingen; Olivier Mercier, Ennetbaden, both of Switzerland

[73] Assignee: BBC Brown, Boveri & Company, Limited, Baden, Switzerland

[21] Appl. No.: 827,568

[22] Filed: Aug. 25, 1977

[30] Foreign Application Priority Data

Aug. 26, 1976 [CH] Switzerland ..... 10827/76

[51] Int. Cl.[2] ..... C22C 19/03

[52] U.S. Cl. ..... 75/134 C; 75/170; 75/171; 148/2; 148/11.5 R; 148/11.5 N; 148/32

[58] Field of Search ..... 75/134 C, 170, 171; 148/2, 11.5 R, 11.5 N, 32

[56] References Cited

U.S. PATENT DOCUMENTS

| | | | |
|---|---|---|---|
| 3,450,372 | 6/1969 | Lange et al. | 75/170 |
| 3,660,082 | 5/1972 | Negishi et al. | 75/171 |

*Primary Examiner*—R. Dean

*Attorney, Agent, or Firm*—Oblon, Fisher, Spivak, McClelland & Maier

[57] ABSTRACT

A shape memory alloy is provided, having a base of nickel and titanium, and additionally comprising up to 30 wt.% copper, and from 0.01 to 5 wt.% of at least one element selected from the group consisting of aluminum, zirconium, cobalt, chromium and iron.

A method of making the above alloys is provided, and articles made therefrom are exemplified.

24 Claims, 3 Drawing Figures

SHAPE MEMORY ALLOYS

BACKGROUND OF THE INVENTION

1. Field of the Invention

The invention is concerned with a shape memory alloy based on nickel and titanium. The invention is further concerned with a method for the production of a memory alloy and its application.

2. Description of the Prior Art

Shape memory alloys based on the intermetallic compound of nickel and titanium and similar related compositions are known in several embodiments. In particular, the martensitic transformation behavior of alloys of stoichiometric or very nearly stoichiometric TiNi composition has been further investigated and described, e.g., R. J. Wasilewski, S. R. Butler, J. E. Hanlon and D. Worden, "Homogeneity Range and the Martensitic Transformation in TiNi", *Metallurgical Transactions*, 2, 229–239 (Jan. 1971).

It is an established fact that the critical temperature of the martensitic transformation is very strongly dependent on the composition of the material. It is obvious from the TiNi phase diagram that several phases of different physical properties must be reckoned with in close proximity to the 50 atomic percent point, and upon these depends very much whether or not an equilibrium condition is reached. Great difficulties are therefore met in trying to obtain reproducible experimental results. In the region from just under 50 atomic percent up to approximately 52 atomic percent nickel, the martensitic transformation temperature shows a steep drop, and several authors have reported different results corresponding to different experimental conditions (see also U.S. Pat. No. 3,351,463 and C. M. Jackson, H. J. Wagner and R. J. Wasilewski, "NASA-SP-5110", NASA Report 1972).

Production technology has been sought to improve the properties of memory alloys and to produce uniform results in the end product through suitable thermal treatment processes (e.g. U.S. Pat. No. 3,594,239). The service behavior of stoichiometric or near-stoichiometric TiNi alloys depends not only on their compositions but also strongly on their previous metallurgical histories. Heat treatments, deformation cycles, and particularly temperature ranges play a decisive role.

Thus, from the current state of the art, it appears difficult to make memory alloys with material characteristics sufficiently exact and reproducible for industrial application. The strong compositional dependence of the temperature of the martensitic transformation in the immediate vicinity of the intermetallic compound TiNi prevents the economic manufacture of this material as well as its general application in the construction of devices. There is a definite need for a cost-saving manufacturing process and for new alloys with a technically feasible, broadened tolerance range of the composition. It is also desirable to be able to additionally influence the martensitic transformation, while avoiding the sharp dependence on fluctuations of the composition.

SUMMARY OF THE INVENTION

Accordingly, an object of the present invention is to provide memory alloys which, in a relatively wide tolerance band of their composition, show physical properties, in particular a martensitic transformation temperature, which are largely independent of this composition.

Another object of the invention is to provide memory alloys which, within the range of industrial manufacturing parameters, yield reproducible values and make possible an economic manufacture.

Yet another object of the invention is to provide alloys which permit the observation of definite, required transformation temperatures.

Briefly, these and other objects of the invention as hereinafter will become more readily apparent can be attained by providing a memory alloy based on the elements nickel and titanium, and also comprising copper up to a maximum content of 30 weight percent, and at least one of the elements aluminum, zirconium, cobalt, chromium and/or iron in amounts from 0.01 to 5 weight percent.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawings, wherein.

DETAILED DESCRIPTION OF THE PREFERRED EMBODIMENTS

Figure 1:
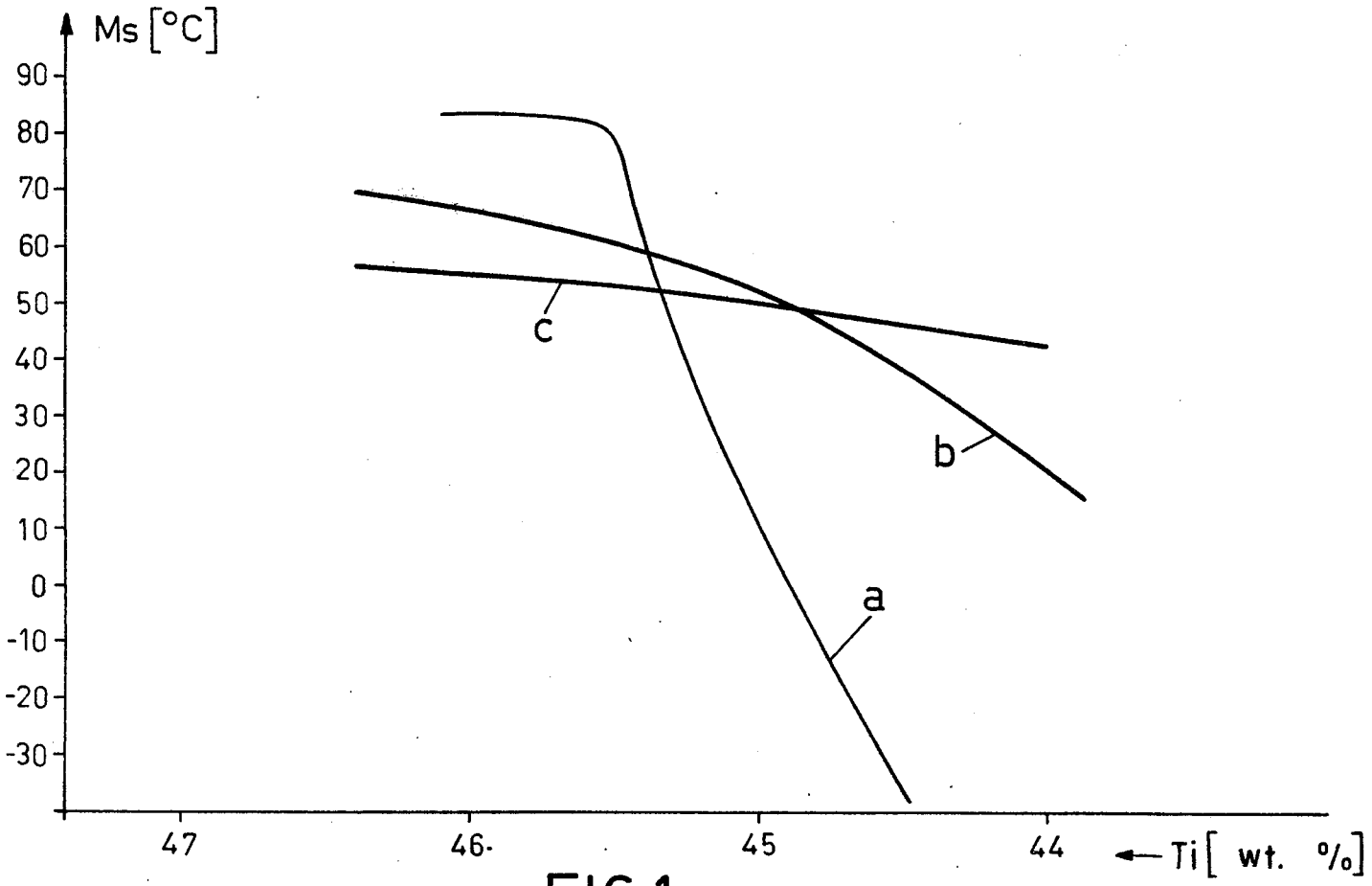
FIG. 1 is a graph showing the dependence of the temperature $M_s$ of the martensitic transformation on the titanium content for alloys containing 0.01 to 0.02% iron, with 0%, 5% and 10% copper.

Memory alloys according to the invention may be produced by transforming suitable raw materials into the final product either by melting or by powder metallurgy. The alloy composition comprises 23–59.5 wt.% nickel, 5.5–46.5 wt.% titanium, 0.5–30 wt.% copper, and 0.01–5 wt.% of at least one of the elements aluminum, zirconium, cobalt, chromium and iron. More than one of the latter elements may be used, such as iron and chromium, cobalt and aluminum and the like.

A particularly advantageous method of production consists of putting the individual components, in the desired proportions, in a water-cooled copper mold and melting them in an arc furnace, under an argon atmosphere from 1.0 to 1.2 bar, using a tungsten electrode, to form the alloy composition; remelting this again in a graphite crucible, under argon, in an induction furnace; casting into a graphite form to make a rod; and subjecting the latter to a heat treatment and a further hot and/or cold working.

A suitable heat treatment includes a homogenizing anneal for from 1.0 to 1.5 hr at a temperature of about 900° C.

Suitable hot working deformations include hot rolling, forging, or extrusion, preferably at temperatures in the range of 600–950° C.

Suitable cold working deformations include cold rolling, swaging, drawing, or deep drawing, with intermediate anneals in the temperature range of 600–950° C. for at least 30 sec.

The fundamental idea of the invention is to influence the composition of the known binary nickel titanium alloy by further additions so that the sharp drop in transformation temperature as a function of composition in the region of the intermetallic compound is avoided. For this purpose, copper has been found to be a particularly effective additional element. Moreover, by further additions, the respective level of the transformation temperature can be suitably modified.

Having generally described the invention, a more complete understanding can be obtained by reference to certain specific examples, which are included for purposes of illustration only and are not intended to be limiting unless otherwise specified.

EXAMPLE 1

The following weighed amounts of alloying elements were melted under an argon atmosphere of 1.1 bar in a water-cooled boat in an arc furnace using tungsten electrodes to form a memory alloy:

Nickel: 8.1 g
Titanium: 6.75 g
Copper: 0.15 g
Iron: 0.0015 g

Buttons thus prepared, weighing approximately 15 g, were turned over and remelted in the arc furnace to homogenize the alloy.

In each case, two buttons thus prepared were remelted in a graphite crucible under an argon atmosphere in an induction furnace (intermediate frequency, 25 kHz) and then cast into a rod 3 mm in diameter. A graphite mold was used for this purpose. Meticulous attention was paid to ensure that no atmospheric oxygen contacted the melt and that the formation of oxides was avoided. Specimens cast in this way showed a maximum Vickers microhardness of 300 kg/mm$^2$ HV. If oxygen is permitted to contaminate the metal bath, a brittle alloy results from oxidation, whose microhardness can rise to 600 kg/mm$^2$ HV, and whose phase transformation temperature is lowered by up to 100° C. Such a material would be unusable in practice.

For the manufacture of relatively large amounts (approx. 2kg) of alloy, buttons were first produced and melted down in a graphite crucible. Then, additional nickel, titanium and copper in elemental form were added to the melt in the form of small pieces.

Rods cast from the melts were homogenized at 950° C. for 1 hr and then their physical properties were investigated. Changes of electrical resistance were used to determine the temperature of the martensitic transformation.

As a specimen is cooled, it passes through temperature ranges corresponding to particular phase transformations. The formation of martensite begins at a temperature $M_s$, and is completed at a temperature $M_f$. On reheating the specimen, the reverse austenitic transformation starts at a temperature $A_s$ which lies above $M_f$ and is complete at a temperature $A_f$. The shape memory effect is known to occur when the material is deformed at a temperature below $M_s$ and heated to a temperature above $A_f$.

The new copper-containing alloys exhibited good formability. The cast rods were annealed for from 1 to 1.5 hr at a temperature of 900° C. and swaged at room temperature with approximately 10% deformation per pass. Intermediate anneals of 2 min. at 900° C. were done between each pass. It was observed that the minimum thermal treatment necessary for further deformation consisted of intermediate annealing in the temperature range from 600° C. to 900° C. for at least 30 sec. By this method, wires with diameters down to 0.5 mm were made. Specimens were analogously cold or hot rolled.

The new alloys showed the memory effect both in the starting (as-cast) condition as well as in the cold worked and heat treated condition. The phase transformation temperature was independent of the heat treatment and of the mechanical deformation.

The final product corresponding to Example 1 had the following composition:

Ni: 54 wt.%
Ti: 45 wt.%
Cu: 1 wt.%
Fe: 0.01 wt.%

The phase transformation temperature was determined as $$M_s = +35° \text{ C.}$$

The following Examples refer to memory alloys prepared analogously to Example 1.

EXAMPLE 2

Weighed amounts of material:

Nickel: 7.5 g
Titanium: 6.75 g
Copper: 0.75 g
Iron: 0.003 g

Composition of the final product:

Ni: 50 wt.%
Ti: 45 wt.%
Cu: 5 wt.%
Fe: 0.02 wt.%

The phase transformation temperature was $$M_s = +52° \text{ C.}$$

EXAMPLE 3

Weighed amounts of material:

Nickel: 7.35 g
Titanium: 6.90 g
Copper: 0.75 g
Iron: 0.0015 g

Composition of the final product:

Ni: 49 wt.%
Ti: 46 wt.%
Cu: 5 wt.%
Fe: 0.01 wt.%

The phase transformation temperature was $$M_s = +66° \text{ C.}$$

EXAMPLE 4

Weighed amounts of material:

Nickel: 6.75 g
Titanium: 6.75 g
Copper: 1.5 g
Iron: 0.003 g

Composition of the final product:

Ni: 45 wt.%
Ti: 45 wt.%
Cu: 10 Wt.%
Fe: 0.02 wt.%

The phase transformation temperature was $$M_s = +50° \text{ C.}$$

EXAMPLE 5

Weighed amounts of material:
Nickel: 6.6 g
Titanium: 6.9 g
Copper: 1.5 g
Iron: 0.003 g
Composition of the final product:
Ni: 44 wt.%
Ti: 46 Wt.%
Cu: 10 Wt.%
Fe: 0.02 wt.%
The phase transformation temperature was $M_s = +55°$ C.

EXAMPLE 6

Weighed amounts of material:
Nickel: 6.75 g
Titanium: 6.9 g
Copper: 1.35 g
Iron: 0.015 g
Composition of the final product:
Ni: 45 wt.%
Ti: 46 wt.%
Cu: 9 wt.%
Fe: 0.01 wt.%
The phase transformation temperature was $M_s = +55°$ C.

Figure 2:
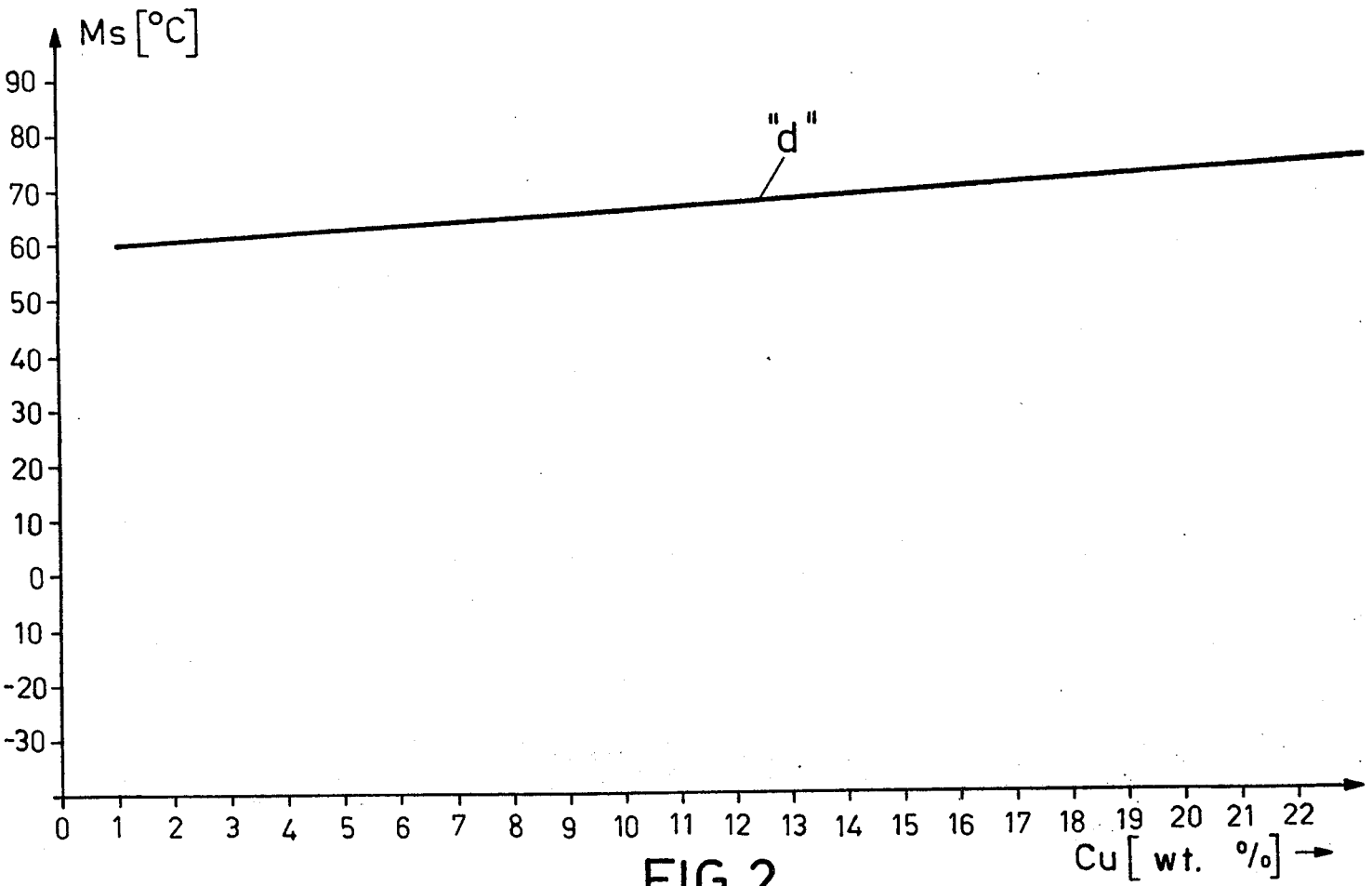
FIG. 2 is a graph showing the dependence of the temperature $M_s$ of the martensitic transformation on copper content for a Ti/Ni/Cu alloy, containing 0.01 to 0.02 wt.% iron, and having a constant titanium content.

The corresponding experimental results from the above examples are graphically represented in FIGS. 1 and 2.

FIG. 1 shows the dependence of the temperature of the martensitic transformation $M_s$ on the titanium content, where the copper content for a particular alloy class was held constant and where each alloy contains 0.01–0.02 wt.% iron. For comparison, $M_s$ values are shown for the known binary, copper-free nickel-titanium alloys in the region of the intermetallic compound TiNi, where the experimental conditions according to Example 1 were adhered to. The curve labelled "a" shows the steep fall of the transformation temperature with increasing nickel content or decreasing titanium content respectively, which is well known from the literature (e.g., Wasilewski et al., loc. cit. and Jackson et al., loc. cit.). Curve "b" represents the temperature $M_s$ of the Ti/Ni/Cu alloys of the invention with a constant copper content of 5 weight percent. As can immediately be seen, the steep fall, characteristic of the strong dependence on titanium/nickel ratio for the binary alloys, has disappeared. The curve "b" has only a slight slope towards the abscissa. This is even more the case for curve "c", which corresponds to alloys with a constant copper content of 10 weight percent.

The dependence of the transformation temperature $M_s$ on copper content for a constant titanium content of 46 weight percent is shown in FIG. 2 as curve "d." It can be seen that the copper systematically changes the transformation temperature, but only slightly, so that its stabilizing character on Ti/Ni alloys again becomes apparent.

The following examples show quaternary memory alloys, which were prepared analogously to Example 1.

EXAMPLE 7

Weighed amounts of material:
Nickel: 6.60 g
Titanium: 6.75 g
Copper: 1.50 g
Cobalt: 0.15 g
Composition of the final product:
Ni: 44 wt.%
Ti: 45 wt.%
Cu: 10 wt.%
Co: 1 wt.%
The phase transformation temperature was $M_s = +43°$ C.

EXAMPLE 8

Weighed amounts of material:
Nickel: 6.45 g
Titanium: 6.90 g
Copper: 1.50 g
Cobalt: 0.15 g
Composition of the final product:
Ni: 43 wt.%
Ti: 46 wt.%
Cu: 10 wt.%
Co: 1 wt.%
The phase transformation temperature was $M_s = +15°$ C.

EXAMPLE 9

Weighed amounts of material:
Nickel: 6.60 g
Titanium: 6.75 g
Copper: 1.50 g
Iron: 0.15 g
Composition of final product:
Ni: 44 wt.%
Ti: 45 wt.%
Cu: 10 Wt.%
Fe: 1 wt.%
The phase transformation temperature was $M_s = -21°$ C.

EXAMPLE 10

Weighed amounts of material:
Nickel: 6.45 g
Titanium: 6.90 g
Copper: 1.50 g
Iron: 0.15 g
Composition of the final product:
Ni: 43 wt.%
Ti: 46 wt.%
Cu: 10 wt.%
Fe: 1 wt.%
The phase transformation temperature was $M_s = +9°$ C.

EXAMPLE 11

Weighed amounts of material:
Nickel: 6.75 g
Titanium: 6.60 g
Copper: 1.50 g
Aluminum: 0.15 g
Composition of the final product:
Ni: 45 wt.%
Ti: 44 wt.%
Cu: 10 wt.%
Al: 1 wt.%
The phase transformation temperature was $M_s = -13°$ C.

EXAMPLE 12

Weighed amounts of material:
Nickel: 6.60 g
Titanium: 6.75 g
Copper: 1.50 g
Aluminum: 0.15 g
Composition of the final product:
Ni: 44 wt.%
Ti: 45 wt.%
Cu: 10 wt.%
Al: 1 wt.%
The phase transformation temperature was $M_s = 0°$ C.

EXAMPLE 13

Weighed amounts of material:
Nickel: 6.45 g
Titanium: 6.90 g
Copper: 1.50 g
Aluminum: 0.15 g
Composition of the final product:

Ni: 43 wt.%
Ti: 46 wt.%
Cu: 10 wt.%
Al: 1 wt.%
The phase transformation temperature was $M_s = +12°$ C.

EXAMPLE 14

Weighed amounts of material:
Nickel: 6.60 g
Titanium: 6.75 g
Copper: 1.50 g
Chromium: 0.15 g
Composition of the final product:
Ni: 44 wt.%
Ti: 45 wt.%
Cu: 10 wt.%
Cr: 1 wt.%
The phase transformation temperature was $M_s = -13°$ C.

EXAMPLE 15

Weighed amounts of material:
Nickel: 6.45 g
Titanium: 6.90 g
Copper: 1.50 g
Chromium: 0.15 g
Composition of the final product:
Ni: 43 wt.%
Ti: 46 wt.%
Cu: 10 wt.%
Cr: 1 wt.%
The phase transformation temperature was $M_s = -25°$ C.

Figure 3:
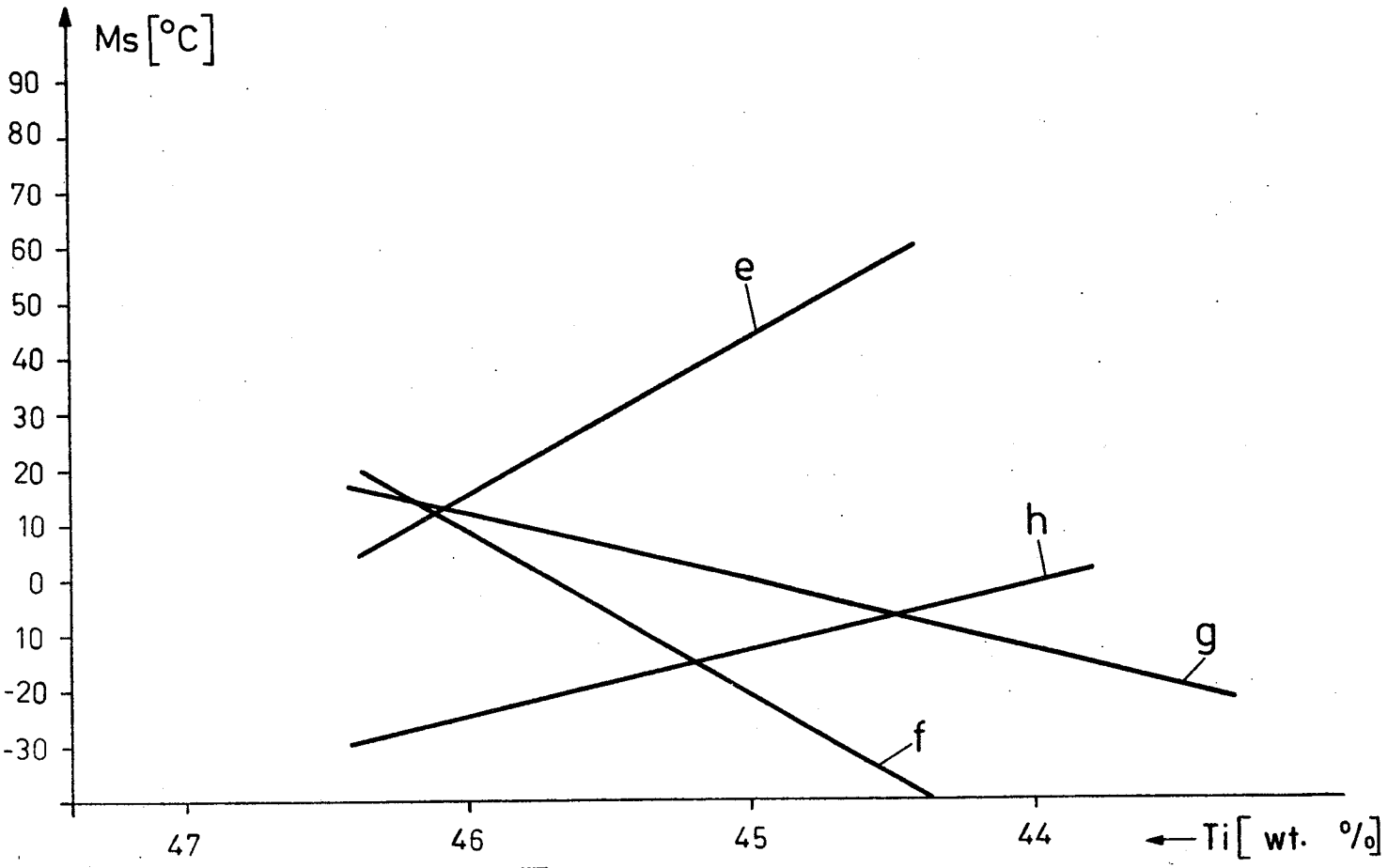
FIG. 3 is a graph showing the dependence of the temperature $M_s$ of the martensitic transformation on titanium content for quaternary alloys with a basic content of 10% copper and further additions.

The corresponding experimental results from the above mentioned examples are graphically represented in FIG. 3. Curve "e" shows the dependence of the transformation temperature $M_s$ on the proportion of nickel to titanium with the simultaneous presence of 10 weight percent copper and 1 weight percent cobalt. Curves "f", "g" and "h" similarly show the influence of 1 wt.% iron, aluminum and chromium respectively, also for a constant copper content of 10%. Apart from cobalt, all additions decrease the $M_s$ point in the range of interest. The effect of aluminum is striking, as it produces the flattest curve "g", and lowers $M_s$ by an average of 50° C. compared with Al-free alloys. Consequently, it is particularly suitable as an additional alloying element. Also curve "h" for chromium shows a flat, although increasing trace. Iron (curve "f") and cobalt (curve "e") behave in an exactly opposite manner. FIG. 3 shows that by a suitable choice of the addition, quaternary alloys can be produced, whose transformation temperatures lie between −40° C. and +60° C.

The alloys corresponding to the invention can be particularly advantageously used for the construction of electrical switches, utilizing both the one way and two way effects. They may serve as elements for either thermal overcurrent or short circuit interrupters, particularly where the elements return to their original positions.

Moreover, the indicated memory alloys could find applications as control elements of thermal control devices or thermal relays. The new memory alloys corresponding to the invention yielded materials whose martensitic transformation temperatures in the region of interest did not show the troublesome sharp fall depending on the titanium/nickel ratio. The alloys make possible the realization of desired information temperatures with great accuracy within a temperature range in the neighborhood of room temperature.

Using the method of preparation according to the invention, memory alloys with reproducible physical properties, in particular the martensitic transformation temperature, can be made, and their economic fabrication made possible.

Having now fully described the invention, it will be apparent to one of ordinary skill in the art that many changes and modifications can be made thereto without departing from the spirit or scope of the invention as set forth herein.

What is claimed as new and intended to be covered by letters patent is:

1. A shape memory alloy whose base elements are nickel and titanium, which consists essentially of:
a mixture of 23 to 55 wt.% nickel, from 40 to 46.5 wt.% titanium and 0.5 to 30 wt.% copper with the balance being from 0.01 to 5 wt.% of at least one element selected from the group consisting of aluminum, zirconium, cobalt, chromium and iron.

2. The shape memory alloy of claim 1, which consists essentially of from 43.5 to 54.5 weight percent nickel, from 44.5 to 46.5 weight percent titanium, and from 0.5 to 10.5 weight percent copper.

3. The shape memory alloy of claim 2, which consists essentially of from 53.5 to 54.5 weight percent nickel, from 44.5 to 45.5 weight percent titanium, and from 0.5 to 1.5 weight percent copper.

4. The shape memory alloy of claim 2, which consists essentially of from 49.5 to 50.5 weight percent nickel, from 44.5 to 45.5 weight percent titanium, and from 4.5 to 5.5 weight percent copper.

5. The shape memory alloy of claim 2, which consists essentially of from 44.5 to 45.5 weight percent nickel, from 44.5 to 45.5 weight percent titanium, and from 9.5 to 10.5 weight percent copper.

6. The shape memory alloy of claim 2, which consists essentially of from 48.5 to 49.5 weight percent nickel, from 45.5 to 46.5 weight percent titanium, and from 4.5 to 5.5 weight percent copper.

7. The shape memory alloy of claim 2, which consists essentially of from 44.5 to 45.5 weight percent nickel, from 45.5 to 46.5 weight percent titanium, and from 8.5 to 9.5 weight percent copper.

8. The shape memory alloy of claim 2, which consists essentially of from 43.5 to 44.5 weight percent nickel, from 45.5 to 46.5 weight percent titanium, and from 9.5 to 10.5 weight percent copper.

9. The shape memory alloy of claim 1, which consists essentially of from 45 to 55 weight percent nickel, from 40 to 46.5 weight percent titanium, from 0.5 to 10 weight percent copper and from 0.01 to 5 weight percent of at least one element selected from the group consisting of aluminum, zirconium, cobalt, chromium and iron.

10. The shape memory alloy of claim 9, which consists essentially of from 45 to 55 weight percent nickel, from 43 to 46.5 weight percent titanium, from 0.5 to 10 percent copper, and from 0.5 to 5 weight percent aluminum.

11. The shape memory alloy of claim 9, which consists essentially of from 45 to 55 weight percent nickel, from 44 to 46.5 weight percent titanium, from 0.5 to 10 weight percent copper, and from 0.5 to 5 weight percent cobalt.

12. The shape memory alloy of claim 9, which consists essentially of from 45 to 55 weight percent nickel, from 44 to 46.5 weight percent titanium, from 0.5 to 10 weight percent copper, and from 0.5 to 5 weight percent chromium.

13. The shape memory alloy of claim 9, which consists essentially of from 45 to 55 weight percent nickel, from 44 to 46.5 weight percent titanium, from 0.5 to 10 weight percent copper, and from 0.01 to 5 weight percent iron.

14. The shape memory alloy of claim 9, which consists essentially of from 45 to 55 weight percent nickel, from 40 to 46.5 weight percent titanium, from 0.5 to 10 weight percent copper, and from 0.5 to 5 weight percent zirconium.

15. In a shaped article which is a part of an apparatus for the conversion of heat into mechanical energy, the improvement which consists of constructing said shaped article from the shape memory alloy of claim 1.

16. The shaped article of claim 15, wherein said shaped article is a non-self-acting element of the thermal overcurrent interrupter of an electrical switch, the element returning into its original position.

17. The shaped article of claim 15, wherein said shaped article is a self-acting element of the thermal overcurrent interrupter of an electrical switch, the element returning into its original position.

18. The shaped article of claim 15, wherein said shaped article is an element for short-circuit interruption in an electrical switch.

19. The shaped article of claim 15, wherein said shaped article is a control element of a thermal regulator or a thermal relay.

20. A method for producing the shape memory alloy of claim 1, which comprises:

forming the starting materials, in the desired proportions, into an alloy composition while excluding oxygen;

remelting said alloy composition under an inert atmosphere and casting the resulting melt to form a desired article; and subjecting said article to a heat treatment and a further working step.

21. The method of claim 20, wherein said starting materials are put into a water-cooled copper mold; melted in an arc furnace under an argon atmosphere of from 1.0 to 1.2 bar, using a tungsten electrode; and the melt is allowed to solidify to form said alloy composition.

22. The method of claim 20, wherein said heat treatment comprises a homogenizing anneal for from 1 to 1.5 hr. at a temperature from 900° C. to 1,000° C.

23. The method of claim 20, wherein said further working step is a hot working which comprises deforming said heat treated shaped article at a temperature of from 600° C. to 950° C.

24. The method of claim 20, wherein said further working step is a cold working which comprises sequential deformations with intermediate anneals at a temperature of from 600° C. to 950° C.

* * * * *